US005897056A

United States Patent [19]

Morikawa et al.

[11] Patent Number: 5,897,056

[45] Date of Patent: Apr. 27, 1999

[54] HEATING APPARATUS FOR VEHICLE

[75] Inventors: Toshio Morikawa, Toyota; Hajime Ito; Shinji Aoki, both of Kariya; Goro Uchida; Yasushi Kato, both of Toyota; Norifumi Ban, Shibetsu; Takashi Ban, Kariya, all of Japan

[73] Assignees: Denso Corporation; Kabushiki Kaisha Toyoda Jidoshokki Seisakusho, both of Kariya, Japan

[21] Appl. No.: 08/994,095

[22] Filed: Dec. 19, 1997

[30] Foreign Application Priority Data

Jan. 28, 1997 [JP] Japan ..... 9-014309

[51] Int. Cl.[6] ..... B60H 1/02

[52] U.S. Cl. ..... 237/12.3 R; 237/12.3 B; 122/26; 126/247

[58] Field of Search ..... 237/12.3 R, 12.3 B, 237/2 A; 122/26; 126/247

[56] References Cited

FOREIGN PATENT DOCUMENTS 6-92134 5/1994 Japan ..... 237/12.3 R

*Primary Examiner*—Henry Bennett
*Assistant Examiner*—Derek S. Boles
*Attorney, Agent, or Firm*—Harness, Dickey & Pierce, PLC

[57] ABSTRACT

A heating apparatus for a vehicle includes a heat exchanger for implementing heat exchange between coolant which has cooled an engine and air directed to a vehicle interior to heat the vehicle interior. A viscous heater has a rotor and a heating chamber containing viscous fluid. The rotor rotates when being subjected to rotational power of the engine. The viscous fluid is subjected to a shear force and is heated when the rotor is subjected to the rotational power. The viscous heater heats the coolant fed to the heat exchanger as the viscous fluid in the heating chamber is heated. A clutch is operative for selectively permitting and inhibiting transmission of the rotational power from the engine to the rotor. A belt transmission device connects the engine and the clutch. A physical quantity detecting device is operative for detecting a physical quantity related to a rotational speed of the rotor. A control device is operative for controlling the clutch to inhibit the transmission of the rotational power from the engine to the rotor when the physical quantity detected by the physical quantity detecting device is equal to or less than a predetermined value.

9 Claims, 11 Drawing Sheets

HEATING APPARATUS FOR VEHICLE

BACKGROUND OF THE INVENTION

1. Field of the Invention

This invention relates to a heating apparatus for a vehicle interior which uses coolant for an engine powering a vehicle body.

2. Description of the Related Art

A conventional heating apparatus for a vehicle interior uses coolant for an engine powering a vehicle body. Specifically, the conventional heating apparatus includes a heater core disposed within a duct. The engine coolant is supplied to the heater core as heating fluid. Air flowing in the duct is heated by the heater core before being discharged into the vehicle interior.

In some efficient engines of the diesel type or the lean-burn type, engine coolant tends to be only heated to an insufficient temperature at which the engine coolant inadequately heats a heater core.

U.S. Pat. No. 4,993,377 corresponding to Japanese published unexamined patent application 2-246823 discloses an automobile heating apparatus. The automobile heating apparatus of U.S. Pat. No. 4,993,377 includes a water pump for circulating the cooling water for an automobile powering engine, a radiator for heating the air to be introduced into the automobile room by utilizing the cooling water delivered by the water pump as a heat source, and a hot water circuit for circulating the cooling water in the automobile powering engine, the water pump, and the radiator. A heat generator is disposed in the hot water circuit at an upstream portion with respect to the radiator. The heat generator includes a heat generating chamber having a labyrinth groove and containing viscous fluid therein, a housing disposed adjacent to the heat generating chamber and having a heat receiving path constituting part of the hot water circuit, a shaft rotatably held in the housing and receiving the rotary torque of the automobile powering engine by way of clutch means, and a rotor fixed on the shaft at an end thereof and having a labyrinth groove disposed in the heat generating chamber.

In the automobile heating apparatus of U.S. Pat. No. 4,993,377, the heat generator includes a shearing-based heater. Specifically, when the clutch means couples the shaft with the output shaft of the automobile powering engine, the shaft is rotated by the engine output shaft and thus the rotor is also rotated. The rotor applies a shear force to the viscous fluid in the heat generating chamber while rotating. The applied shear force causes the viscous fluid to be heated. The cooling water is heated as the viscous fluid is heated. As a result, the cooling water can be heated to a sufficient temperature or a desired temperature.

A related drawing in U.S. Pat. No. 4,993,377 shows that the clearance between the rotor and the housing is very small. Accordingly, it appears that the rotor tends to be locked to the housing by a cause such as deformation of the rotor relative to the housing or movement of a foreign body into the clearance.

Japanese published unexamined patent application 6-92134 discloses a heating apparatus for a vehicle which includes an auxiliary heater of a shearing-based type. In the heating apparatus of Japanese application 6-92134, a portion of coolant flows from the body of a vehicle powering engine to an air-heating core via the auxiliary heater. The auxiliary heater contains viscous fluid. The auxiliary heater has a shaft. As the shaft is rotated, a shear force is applied to the viscous fluid. The applied shear force causes the viscous fluid to be heated. The coolant in the auxiliary heater is heated as the viscous fluid is heated. The shaft of the auxiliary heater is connected to the output shaft of the vehicle powering engine via an electromagnetic clutch and a power transmission mechanism using a belt. When the electromagnetic clutch is in its engaged position, the shaft of the heater can be rotated by the output shaft of the vehicle powering engine. When the electromagnetic clutch is in its disengaged position, the shaft of the heater is uncoupled from the output shaft of the vehicle powering engine.

In the heating apparatus of Japanese application 6-92134, a temperature sensor detects the temperature of coolant directed from the body of the vehicle powering engine to the auxiliary heater. When the detected temperature of the coolant is relatively low, a computer-based controller sets the electromagnetic clutch in its disengaged position to suspend operation of the auxiliary heater.

SUMMARY OF THE INVENTION

It is an object of this invention to provide an improved heating apparatus for a vehicle interior.

A first aspect of this invention provides a heating apparatus for a vehicle, comprising (a) a heat exchanger for implementing heat exchange between coolant which has cooled an engine and air directed to a vehicle interior to heat the vehicle interior; (b) a viscous heater including a rotor and a heating chamber containing viscous fluid, the rotor rotating when being subjected to rotational power of the engine, the viscous fluid being subjected to a shear force and being heated when the rotor is subjected to the rotational power, the viscous heater heating the coolant fed to the heat exchanger as the viscous fluid in the heating chamber is heated; (c) a clutch for selectively permitting and inhibiting transmission of the rotational power from the engine to the rotor; (d) a belt transmission device connecting the engine and the clutch; (e) physical quantity detecting means for detecting a physical quantity related to a rotational speed of the rotor; and (f) control means for controlling the clutch to inhibit the transmission of the rotational power from the engine to the rotor when the physical quantity detected by the physical quantity detecting means is equal to or less than a predetermined value.

A second aspect of this invention is based on the first aspect thereof, and provides a heating apparatus wherein the belt transmission device comprises a belt for transmitting the rotational power to the rotor of the viscous heater and engine-driven devices including an alternator, a pump, a blower, and a compressor.

A third aspect of this invention provides a heating apparatus for a vehicle, comprising (a) a heat exchanger for implementing heat exchange between coolant which has cooled an engine and air directed to a vehicle interior to heat the vehicle interior; (b) a viscous heater including a rotor and a heating chamber containing viscous fluid, the rotor rotating when being subjected to rotational power of the engine, the viscous fluid being subjected to a shear force and being heated when the rotor is subjected to the rotational power, the viscous heater heating the coolant fed to the heat exchanger as the viscous fluid in the heating chamber is heated; (c) a clutch for selectively permitting and inhibiting transmission of the rotational power from the engine to the rotor; (d) a belt transmission device connecting the engine and the clutch; (e) first physical quantity detecting means for detecting a first physical quantity related to a rotational speed of the engine; (f) second physical quantity detecting means for detecting a second physical quantity related to a rotational speed of the rotor; and (g) control means for controlling the clutch to inhibit the transmission of the rotational power from the engine to the rotor when a difference between the first physical quantity detected by the first physical quantity detecting means and the second physical quantity detected by the second physical quantity detecting means is greater than a predetermined value.

A fourth aspect of this invention is based on the third aspect thereof, and provides a heating apparatus wherein the belt transmission device comprises a belt for transmitting the rotational power to the rotor of the viscous heater and engine-driven devices including an alternator, a pump, a blower, and a compressor.

A fifth aspect of this invention provides a heating apparatus for a vehicle, comprising an engine having a body; first means for circulating coolant through a closed path having a portion extending through the body of the engine; a mechanically-driven heater connected to a region of the closed path downstream of the engine for heating the coolant exiting from the body of the engine; second means connected to a region of the closed path downstream of the mechanically-driven heater for heating a vehicle interior in response to the coolant heated by the mechanically-driven heater; third means for coupling the mechanically-driven heater to the engine to drive the mechanically-driven heater by the engine; fourth means for detecting whether or not the mechanically-driven heater is operating abnormally; and fifth means for uncoupling the mechanically-driven heater from the engine to deactivate the mechanically-driven heater when the fourth means detects that the mechanically-driven heater is operating abnormally.

A sixth aspect of this invention is based on the fifth aspect thereof, and provides a heating apparatus wherein the engine comprises a rotatable output shaft, and the mechanically-driven heater comprises a rotatable drive shaft, and wherein the fourth means comprises means for detecting a rotational speed of the output shaft, means for detecting a rotational speed of the drive shaft, and means for deciding whether or not a relation between the detected rotational speed of the output shaft and the detected rotational speed of the drive shaft is in a predetermined range.

A seventh aspect of this invention is based on the fifth aspect thereof, and provides a heating apparatus wherein the mechanically-driven heater comprises a rotatable drive shaft, and wherein the fourth means comprises means for detecting a rotational speed of the drive shaft, and means for comparing the detected rotational speed of the drive shaft with a predetermined reference speed.

DESCRIPTION OF THE PREFERRED EMBODIMENTS

First Embodiment

Figure 1:
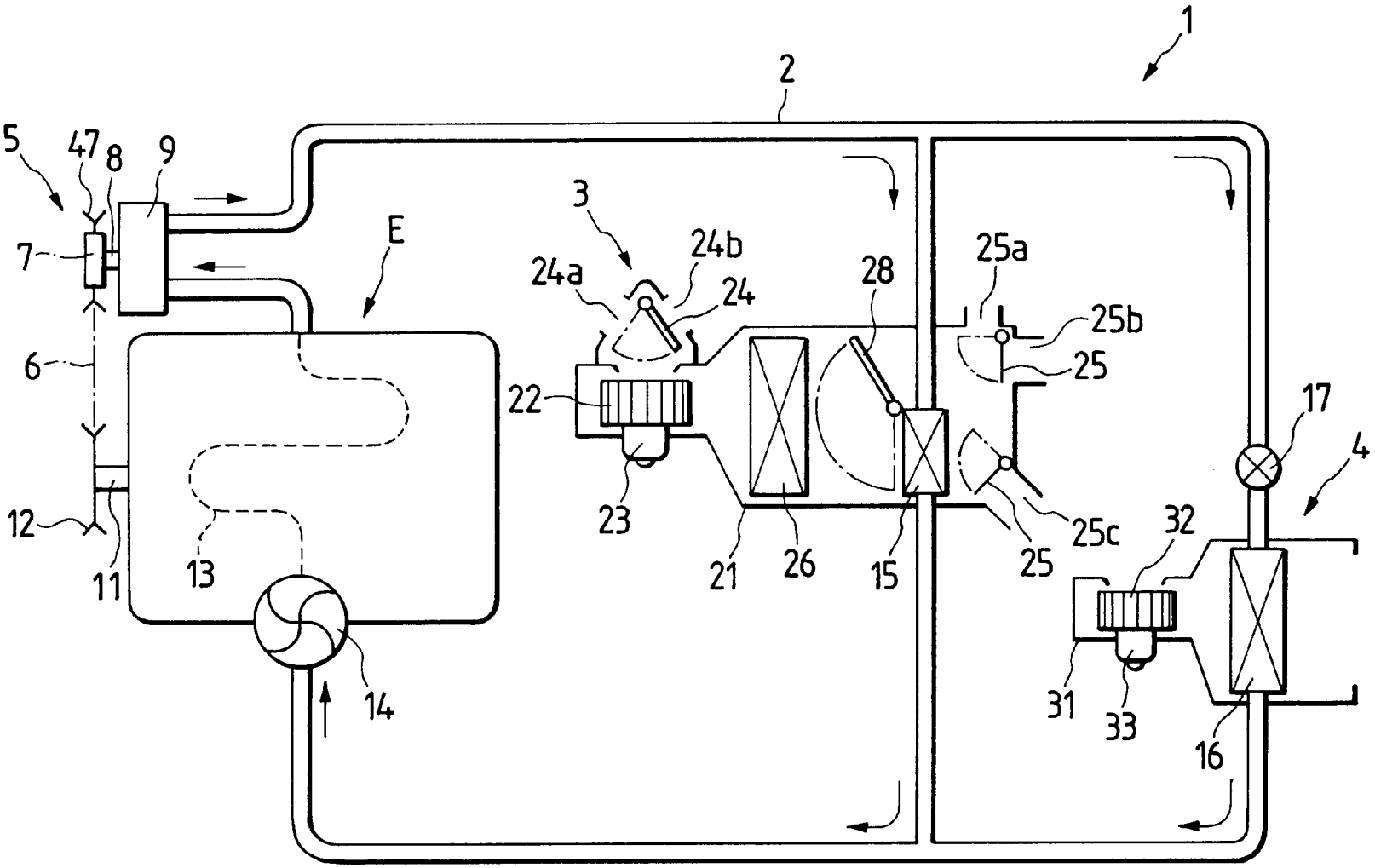
FIG. 1 is a diagram of an air conditioning system for a vehicle interior which includes a heating apparatus according to a first embodiment of this invention.

With reference to FIG. 1, an air conditioning system 1 for a vehicle interior includes a coolant circuit 2 for circulation of engine coolant (engine cooling water) related to a vehicle powering engine "E". The vehicle powering engine "E" is of, for example, the diesel type. The vehicle powering engine "E" may be of the spark-ignition internal combustion type. The air conditioning system 1 also includes an air conditioner 3, a rear heater 4, a power transmission mechanism 5, and a shearing-based heater 9. The air conditioner 3 serves to condition air in a vehicle interior. The rear heater 4 serves to heat a rear portion of the vehicle interior. The power transmission mechanism 5 serves to transmit mechanical power from the engine "E" to engine-driven devices. The shearing-based heater 9 is one of the engine-driven devices. The shearing-based heater 9 is connected to a portion of the coolant circuit 2 downstream of the engine "E". The shearing-based heater 9 serves to heat the engine coolant (the engine cooling water). The shearing-based heater 9 is also referred to as the viscous heater 9.

The engine "E" is located in an engine room within a vehicle body. The engine "E" serves as a heating source for heating the vehicle interior. The engine "E" also serves as a mechanical power source for activating the viscous heater 9 and other engine-driven devices.

Figure 2:
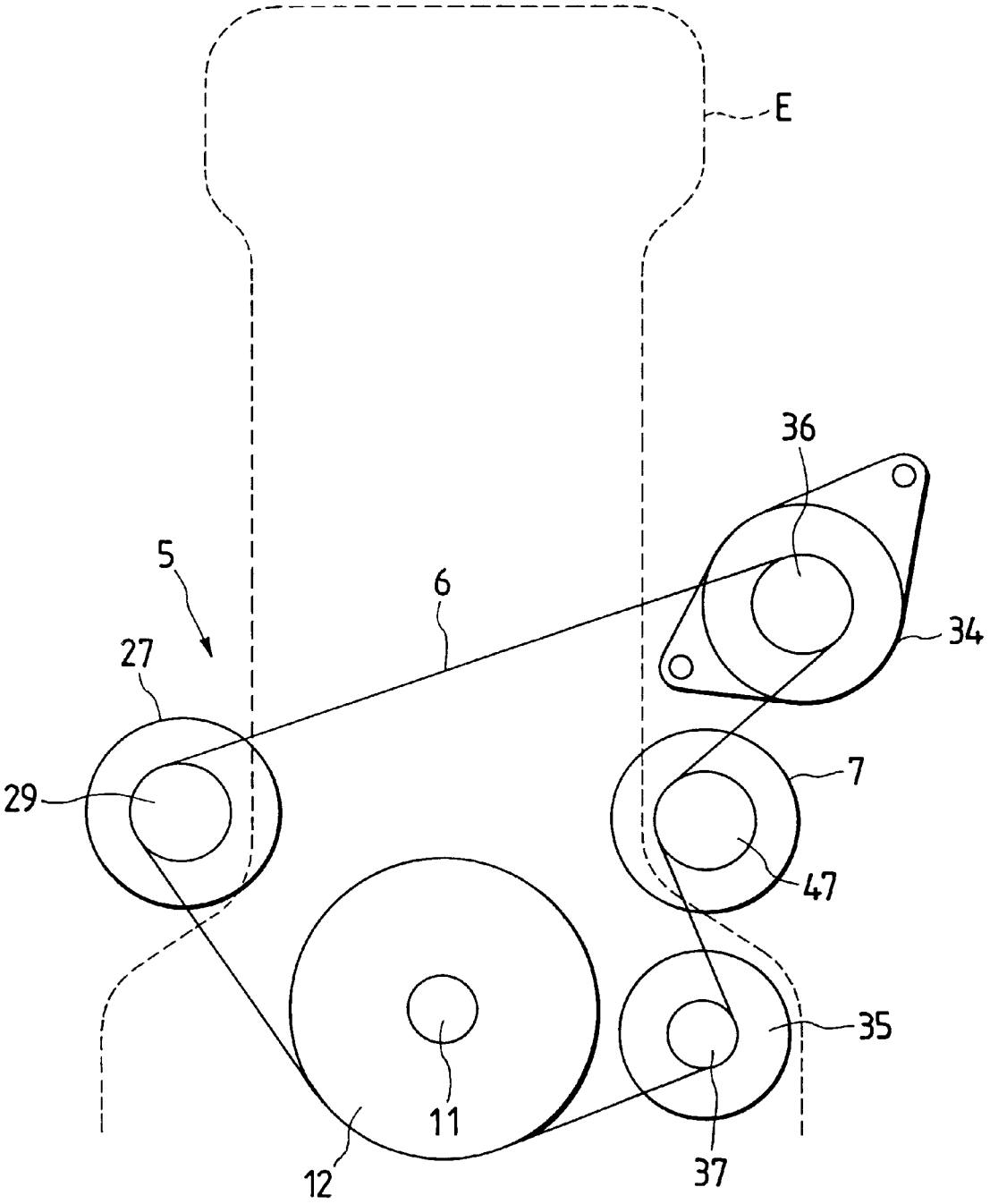
FIG. 2 is a diagram of an engine and a power transmission mechanism in FIG. 1.

As shown in FIGS. 1 and 2, the engine "E" has a crankshaft or an output shaft 11 on which a crank pulley 12 is mounted. The crank pulley 12 connects with a V belt 6. The engine "E" has a cylinder block and a cylinder head formed with a water jacket 13. The water jacket 13 is disposed in the coolant circuit 2. In other words, the water jacket 13 forms a portion of the coolant circuit 2. In the coolant circuit 2, the position of the water jacket 13 is upstream of the viscous heater 9.

The coolant circuit 2 is provided with a water pump 14 for driving the engine coolant, and a radiator (not shown) for cooling the engine coolant by implementing heat exchange between the engine coolant and externally-fed air. The coolant circuit 2 is also provided with a front-side heater core 15, a rear-side heater core 16, and a water valve 17. The engine coolant flows through the front-side heater core 15. The front-side heater core 15 serves to heat air directed toward a front portion of the vehicle interior by implementing heat exchange between the engine coolant and the air. The engine coolant can flow through the rear-side heater core 16. The rear-side heater core 16 serves to heat air directed toward a rear portion of the vehicle interior by implementing heat exchange between the engine coolant and the air. The water valve 17 selectively permits and inhibits the feed of the engine coolant to the rear-side heater core 16. The water pump 14 is disposed in the coolant circuit 2 at a position upstream of the water jacket 13 in the body of the engine "E". The water pump 14 has a drive shaft connected to the crankshaft of the engine "E". The drive shaft of the water pump 14 is rotated by the crankshaft of the engine "E". Thus, the water pump 14 is driven by the engine "E".

The air conditioner 3 includes a front-side duct 21, a front-side blower 22, an evaporator 26, and the front-side heater core 15. The evaporator 26 is contained in a refrigeration cycle system. An upstream end of the front-side duct 21 has an outside-air inlet 24*a* and an inside-air inlet 24*b*. The outside-air inlet 24*a* leads to an exterior of the vehicle body. The inside-air inlet 24*b* leads to the vehicle interior. An inside-air/outside-air change damper 24 is rotatably disposed in the upstream end of the front-side duct 21. The inside-air/outside-air change damper 24 can rotate between first and second positions. When the inside-air/outside-air change damper 24 assumes its first position, the damper 24 blocks the outside-air inlet 24*a* and unblocks the inside-air inlet 24*b*. When the inside-air/outside-air change damper 24 assumes its second position, the damper 24 blocks the inside-air inlet 24*b* and unblocks the outside-air inlet 24*a*. Thus, the inside-air/outside-air change damper 24 serves to select one of the outside-air inlet 24*a* and the inside-air inlet 24*b* as an active inlet. A downstream end of the front-side duct 21 has a defroster outlet 25*a*, a face outlet 25*b*, and a foot outlet 25*c*. The defroster outlet 25*a* is directed toward the inner surfaces of the windshield of the vehicle body. The face outlet 25*b* is directed toward an upper area of the front portion of the vehicle interior. The foot outlet 25*c* is directed to a lower area of the front portion of the vehicle interior. Change dampers 25A and 25B are rotatably disposed in the downstream end of the front-side duct 21. The change damper 25A can rotate between first and second positions. When the change damper 25A assumes its first position, the damper 25A blocks the defroster outlet 25*a* and unblocks the face outlet 25*b*. When the change damper 25A assumes its second position, the damper 25A blocks the face outlet 25*b* and unblocks the defroster outlet 25*a*. Thus, the change damper 25A serves to select one of the defroster outlet 25*a* and the face outlet 25*b* as an active outlet. The change damper 25B selectively blocks and unblocks the foot outlet 25*c*. The front-side blower 22 extends in a region of the front-side duct 21 downstream of the inside-air/outside-air change damper 24. The front-side blower 22 is driven by a blower motor 23. The front-side blower 22 draws air via the outside-air inlet 24*a* or the inside-air inlet 24*b*, and drives the air toward the vehicle interior along the front-side duct 21. The front-side blower 22 is preferably of a centrifugal type.

The refrigeration cycle system includes a compressor, a condenser, a receiver, an expansion valve, and the evaporator 26 which are connected in a closed circuit or a closed loop by refrigerant pipings. The compressor has a drive shaft which can be coupled to and uncoupled from the crankshaft 11 of the engine "E". When the drive shaft of the compressor is coupled to the crankshaft 11 of the engine "E", the compressor is driven by the engine "E". The compressor is one of the engine-driven devices. The compressor receives refrigerant from the evaporator 26, and compresses the received refrigerant and outputs the compression-resultant refrigerant to the condenser. The evaporator 26 is located in a region of the front-side duct 21 downstream of the front-side blower 22. The evaporator 26 serves to cool air which flows in the front-side blower 22.

The front-side heater core 15 forms a heat exchanger for an air heating process. The front-side heater core 15 is located in a region of the front-side duct 21 downstream of the evaporator 26. The front-side heater core 15 is connected to a portion of the coolant circuit 2 downstream of the viscous heater 9 but upstream of the water pump 14. The front-side core 15 implements heat exchange between the engine coolant and the air which has passed through the evaporator 26. Thereby, the front-side core 15 heats the air flowing in the front-side duct 21.

An air mix damper 28 is rotatably disposed in a region of the front-side duct 21 upstream of the front-side heater core 15 but downstream of the evaporator 26. The air mix damper 28 controls the ratio between the rate of an air flow passing through the front-side heater core 15 and the rate of an air flow bypassing the front-side heater core 15, thereby adjusting the temperature of air discharged into the vehicle interior via the front-side duct 21. The air mix damper 28 is connected via a link plate or link plates (not shown) to an actuator such as a servo motor. The air mix damper 28 is driven by the actuator.

A coolant passage in the coolant circuit 2 downstream of the viscous heater 9 forks into first and second branches. The front-side heater core 15 is connected to the first branch. The water valve 17 and the rear-side heater core 16 are connected to the second branch. The first and second branches meet at a position upstream of the water pump 14.

The rear heater 4 includes a rear-side duct 31, a rear-side blower 32, and the rear-side heater core 16. An upstream end of the rear-side duct 31 has an inlet. A downstream end of the rear-side duct 31 has a foot outlet directed toward a lower area of the rear portion of the vehicle interior. The rear-side blower 32 extends in the upstream end of the rear-side duct 31. The rear-side blower 32 is driven by a blower motor 33. The rear-side blower 32 draws air via the inlet, and drives the air toward the vehicle interior along the rear-side duct 31. The rear-side blower 32 is preferably of a centrifugal type.

The rear-side heater core 16 forms a heat exchanger for an air heating process. The rear-side heater core 16 is located in a region of the rear-side duct 31 downstream of the rear-side blower 32. The rear-side heater core 16 is connected to a portion of the coolant circuit 2 downstream of the viscous heater 9 but upstream of the water pump 14. In the coolant circuit 2, the position of the rear-side heater core 16 is downstream of the water valve 17. The rear-side core 16 implements heat exchange between the engine coolant and the air which flows in the rear-side duct 31. Thereby, the rear-side core 16 heats the air flowing in the rear-side duct 31.

Figure 3:
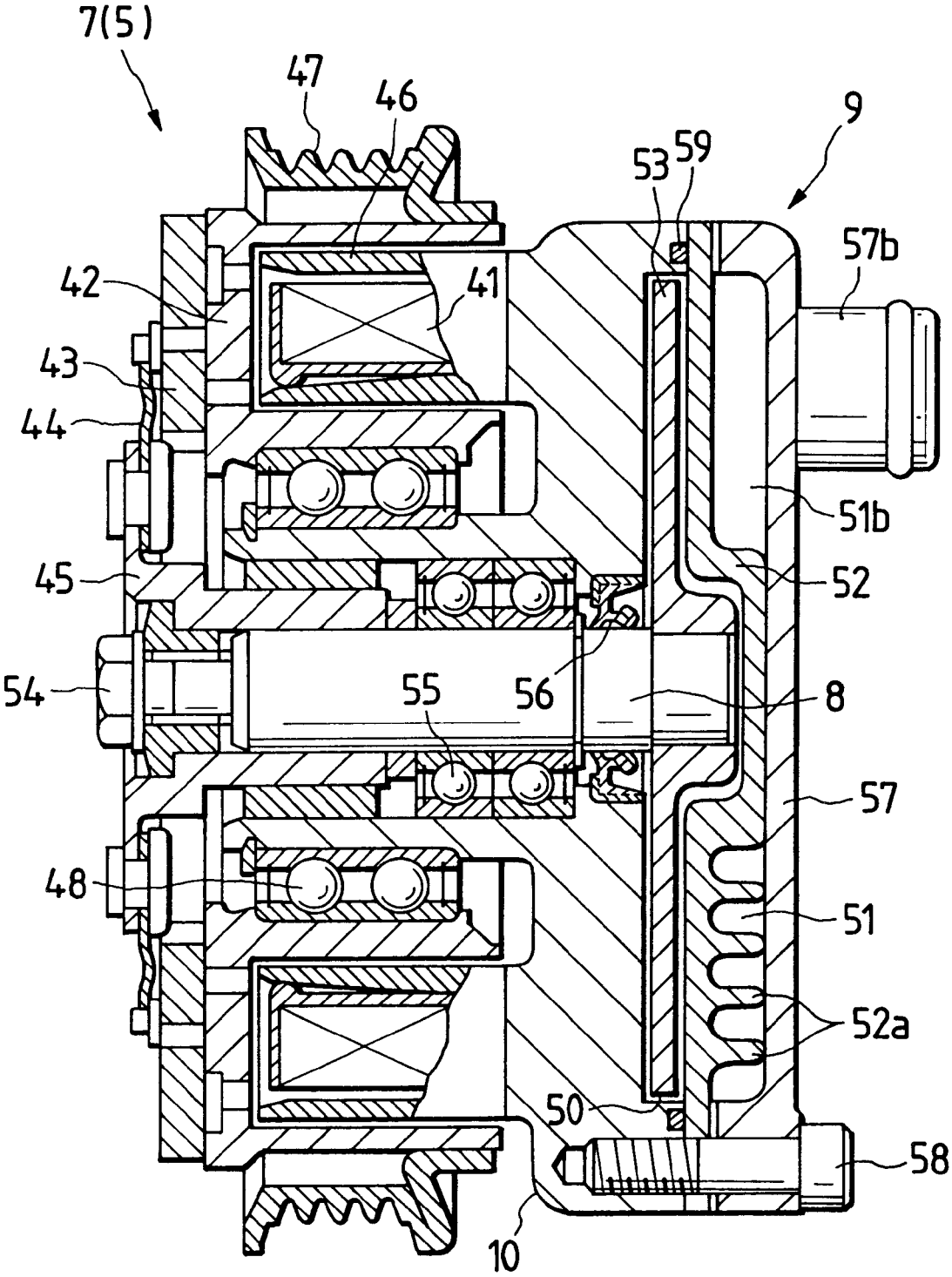
FIG. 3 is a sectional view of a viscous clutch and a viscous heater in FIG. 1.

With reference to FIGS. 1, 2, and 3, the power transmission mechanism 5 includes the V belt 6 which is in engagement with the crank pulley 12 mounted on the crankshaft 11 of the engine "E". The V belt 6 connects with an electromagnetic clutch 27, an alternator 34, a hydraulic pump 35, and an electromagnetic clutch 7. The electromagnetic clutch 27 connects with the compressor in the refrigeration cycle system in the air conditioner 3. The electromagnetic clutch 27 is also referred to as the air-conditioner clutch 27. The alternator 34 is one of the engine-driven devices.

The hydraulic pump 35 is a member of a vehicle power steering apparatus. The hydraulic pump 35 is one of the engine-driven devices. The electromagnetic clutch 7 connects with the viscous heater 9. The electromagnetic clutch 7 is also referred to as the viscous clutch 7.

The air-conditioner clutch 27 can change between an engaged state (an on state) and a disengaged state (an off state). The air-conditioner clutch 27 includes a pulley 29 which is in engagement with the V belt 6. The air-conditioner clutch 27 selectively couples and uncouples the drive shaft of the compressor to and from the pulley 29. Thus, the air-conditioner clutch 27 selectively connects and disconnects the compressor to and from the engine "E". When the air-conditioner clutch 27 connects the compressor to the engine "E", the compressor is driven by the engine "E". When the air-conditioner clutch 27 disconnects the compressor from the engine "E", operation of the compressor is suspended.

The alternator 34 includes a pulley 36 which is in engagement with the V belt 6. The alternator 34 has a drive shaft on which the pulley 36 is mounted. The alternator 34 continues to be driven by the engine "E".

The hydraulic pump 35 in the vehicle power steering apparatus includes a pulley 37 which is in engagement with the V belt 6. The hydraulic pump 35 has a drive shaft on which the pulley 37 is mounted. The hydraulic pump 35 continues to be driven by the engine "E".

The viscous clutch 7 can change between an engaged state (an on state) and a disengaged state (an off state). The viscous clutch 7 includes a pulley 47 which is in engagement with the V belt 6. The viscous clutch 7 selectively couples and uncouples a drive shaft of the viscous heater 9 to and from the pulley 47. Thus, the viscous clutch 7 selectively connects and disconnects the viscous heater 9 to and from the engine "E". When the viscous clutch 7 connects the viscous heater 9 to the engine "E", the viscous heater 9 is activated by the engine "E". When the viscous clutch 7 disconnects the viscous heater 9 from the engine "E", the viscous heater 9 is deactivated.

As the crank pulley 12 is rotated by the engine "E", the V belt 6 moves. The pulleys 29, 36, 37, and 47 rotate in accordance with the movement of the V belt 6. When the air-conditioner clutch 27 couples the drive shaft of the compressor to the pulley 29, the drive shaft of the compressor rotates together with the pulley 29 so that the compressor operates normally. When the air-conditioner clutch 27 uncouples the drive shaft of the compressor from the pulley 29, the drive shaft of the compressor stops and hence the compressor is deactivated. The drive shaft of the alternator 34 rotates together with the pulley 36. Thus, the alternator 34 is activated in accordance with the rotation of the pulley 36. The drive shaft of the hydraulic pump 35 rotates together with the pulley 37. Thus, the hydraulic pump 35 is activated in accordance with the rotation of the pulley 37. When the viscous clutch 7 couples the drive shaft of the viscous heater 9 to the pulley 47, the drive shaft of the viscous heater 9 rotates together with the pulley 47 so that the viscous heater 9 is activated. When the viscous clutch 7 uncouples the drive shaft of the viscous heater 9 from the pulley 47, the drive shaft of the viscous heater 9 stops and hence the viscous heater 9 is deactivated.

As shown in FIG. 3, the viscous clutch 7 includes a coil or a winding 41, a rotor 42, an armature 43, and an inner hub 45. The rotor 42 is fixedly connected to the pulley 47 so that the rotor 42 continues to be rotated by the engine "E". The inner hub 45 is mounted on a drive shaft 8 of the viscous heater 9. The inner hub 45 is connected to the armature 43 via a leaf spring 44. When the coil 41 is energized, the armature 43 is moved by the coil 41 into engagement with the rotor 42. In this case, the armature 43, the inner hub 45, and the drive shaft 8 of the viscous heater 9 rotate together with the rotor 42. When the coil 41 is de-energized, the armature 43 is moved out of engagement with the rotor 42 by the leaf spring 44. In this case, the armature 43, the inner hub 45, and the drive shaft 8 of the viscous heater 9 stop.

The coil 41 includes a winding of an electrically conductive wire having an insulating coating. The coil 41 is provided in a stator 46 made of magnetic material such as iron. The coil 41 is bonded to walls of the stator 46 by epoxy resin. The stator 46 is fixed to a front surface of a housing 10 of the viscous heater 9.

The pulley 47 is fixed to outer circumferential surfaces of the rotor 42 by, for example, a welding process. As previously indicated, the rotor 42 continues to be rotated by the engine "E". The rotor 42 forms an input portion of the viscous clutch 7. The rotor 42 is made of magnetic material such as iron. The rotor 42 has the form of a cylinder with a central opening. The walls of the rotor 42 have a U-shaped cross-section. The rotor 42 serves as a first frictional member. The rotor 42 has a frictional end surface. The rotor 42 extends around a cylindrical projection of the housing 10 of the viscous heater 9. A bearing 48 rotatably supports the rotor 42 on the cylindrical projection of the housing 10.

The armature 43 is made of magnetic material such as iron. The armature 43 has the form of a ring. The armature 43 serves as a second frictional member. The armature 43 has a frictional surface which faces the frictional surface of the rotor 42 in an axial direction. Normally, the frictional surface of the armature 43 separates from the frictional surface of the rotor 42 by a predetermined gap of, for example, 0.5 mm. The armature 43 is axially movable toward and away from the rotor 42. When the coil 41 is energized, the armature 43 is moved by the coil 41 toward the rotor 42 so that the frictional surface of the armature 43 falls into engagement with the frictional surface of the rotor 42. In this case, the armature 43 rotates together with the rotor 42.

The leaf spring 44 has an outer portion which is attached to the armature 43 by suitable fixing members such as rivets. The leaf spring 44 has an inner portion which is attached to the inner hub 45 by suitable fixing members such as rivets. The leaf spring 44 urges the armature 43 relative to the inner hub 45 in an axial direction away from the rotor 42. When the coil 41 is de-energized, the armature 43 is moved by the leaf spring 44 away from the rotor 42 so that the frictional surface of the armature 43 moves out of engagement with the frictional surface of the rotor 42. In this case, the armature 43 stops. The leaf spring 44 serves as a resilient member for returning the armature 43 in its initial position (its normal position) upon the de-energization of the coil 41.

The inner hub 45 is connected to the armature 43 via the leaf spring 44. When the armature 43 rotates, the inner hub 45 also rotates. The inner hub 45 is mounted on the drive shaft 8 of the viscous heater 9 via a spline connection. The drive shaft 8 rotates in accordance with the rotation of the inner hub 45.

The viscous heater 9 is an auxiliary heating source while the engine "E" is a main heating source. The viscous heater 9 includes the drive shaft 8, the housing 10, a separator 52, and a rotor 53. The drive shaft 8 is rotatably supported on the walls of the housing 10. The housing 10 has an inner space which is divided by the separator 52 into a heating chamber 50 and a coolant chamber 51.

The rotor 53 is mounted on the drive shaft 8. The rotor 53 rotates in accordance with the rotation of the drive shaft 8. The rotor 53 extends in the heating chamber 50.

The drive shaft 8 of the viscous heater 9 is attached to the inner hub 45 of the viscous clutch 7 by a suitable fixing member such as a bolt. The drive shaft 8 is rotatable together with the armature 43. The drive shaft 8 forms an input shaft of the viscous heater 9. The drive shaft 8 is rotatably supported within the housing 10 by a bearing 55 and a sealing member 56. The sealing member 56 includes an oil seal for blocking or preventing the leakage of viscous fluid.

The housing 10 is made of metal such as an aluminum alloy. A rear end of the housing 10 has a disk-shaped cover 57 which is attached to a main portion of the housing 10 by suitable fixing members 58 such as bolts or nuts. An outer edge of the separator 52 is sandwiched between the wall of the cover 57 and the wall of the main portion of the housing 10. A sealing member 59 is provided between the separator 52 and the main portion of the housing 10. The sealing member 59 includes an O ring for blocking or preventing the leakage of viscous fluid.

The separator 52 is made of metal such as an aluminum ally which has a high thermal conductivity. The separator 52 forms a partition whose outer edge is sandwiched between a cylindrical projection of the cover 57 and a cylindrical projection of the main portion of the housing 10. The heating chamber 50 extends between the separator 52 and the main portion of the housing 10. The heating chamber 50 is fluid-tightly (sealingly) filled with viscous fluid such as silicone oil having a high viscosity. The viscous fluid heats when being subjected to a shear force.

Figure 4:
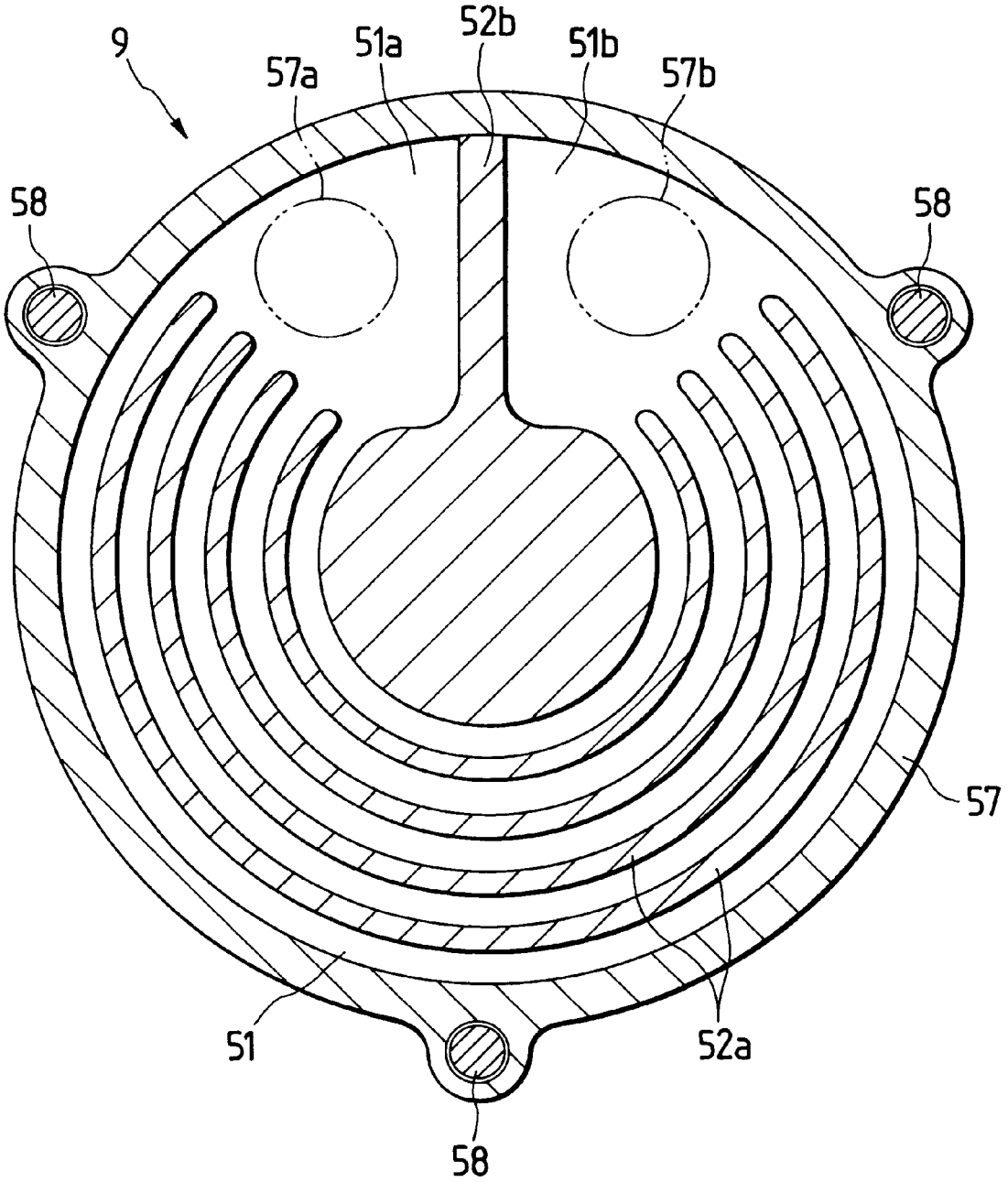
FIG. 4 is a sectional view of the viscous heater in FIGS. 1 and 3.

With reference to FIGS. 3 and 4, the coolant chamber 51 fluid-tightly (sealingly) extends between the separator 52 and the cover 57. The engine coolant enters the coolant chamber 51, flowing in the coolant chamber 51 before exiting therefrom. The separator 52 has fins 52*a* projecting into the coolant chamber 51. The fins 52 extend along arcs of concentric circles, respectively. Circumferentially-extending passages for the engine coolant are defined between the fins 52*a*. The coolant passages are concentric with each other. The fins 52*a* provide efficient heat exchange between the viscous fluid and the engine coolant.

The fins 52*a* may be replaced by an arrangement of projections and grooves on and in the separator 52. The fins 52*a* may be replaced by a heat-transmission facilitating member provided on the cover 57. An example of the heat-transmission facilitating member is an arrangement of corrugated fins or small pin fins. The heating chamber 50 may be formed by a labyrinth sealing structure extending between the separator 52 and the rotor 53.

The separator 52 has a partition wall 52*b* projecting into the coolant chamber 51. The partition wall 52*b* separates upstream ends of the coolant passages in the coolant chamber 51 from downstream ends thereof. The cover 57 is formed with an inlet 57*a* communicating with the upstream ends of the coolant passages in the coolant chamber 51. Also, the cover 57 is formed with an outlet 57*b* communicating with the downstream ends of the coolant passages in the coolant chamber 51. The engine coolant enters the coolant chamber 51 via the inlet 57*a*, flowing through the coolant passages before exiting from the coolant chamber 51 via the outlet 57*b*.

The rotor 53 rotatably extends in the heating chamber 50. The rotor 53 is mounted on a rear end of the drive shaft 8. An outer circumferential surface or side surfaces of the rotor 53 have grooves (not shown), and projections between the grooves. When the drive shaft 8 rotates, the rotor 53 rotates together with the drive shaft 8. The rotor 53 applies shear forces to the viscous fluid while rotating. The viscous fluid heats in response to the applied shear forces.

Figure 5:
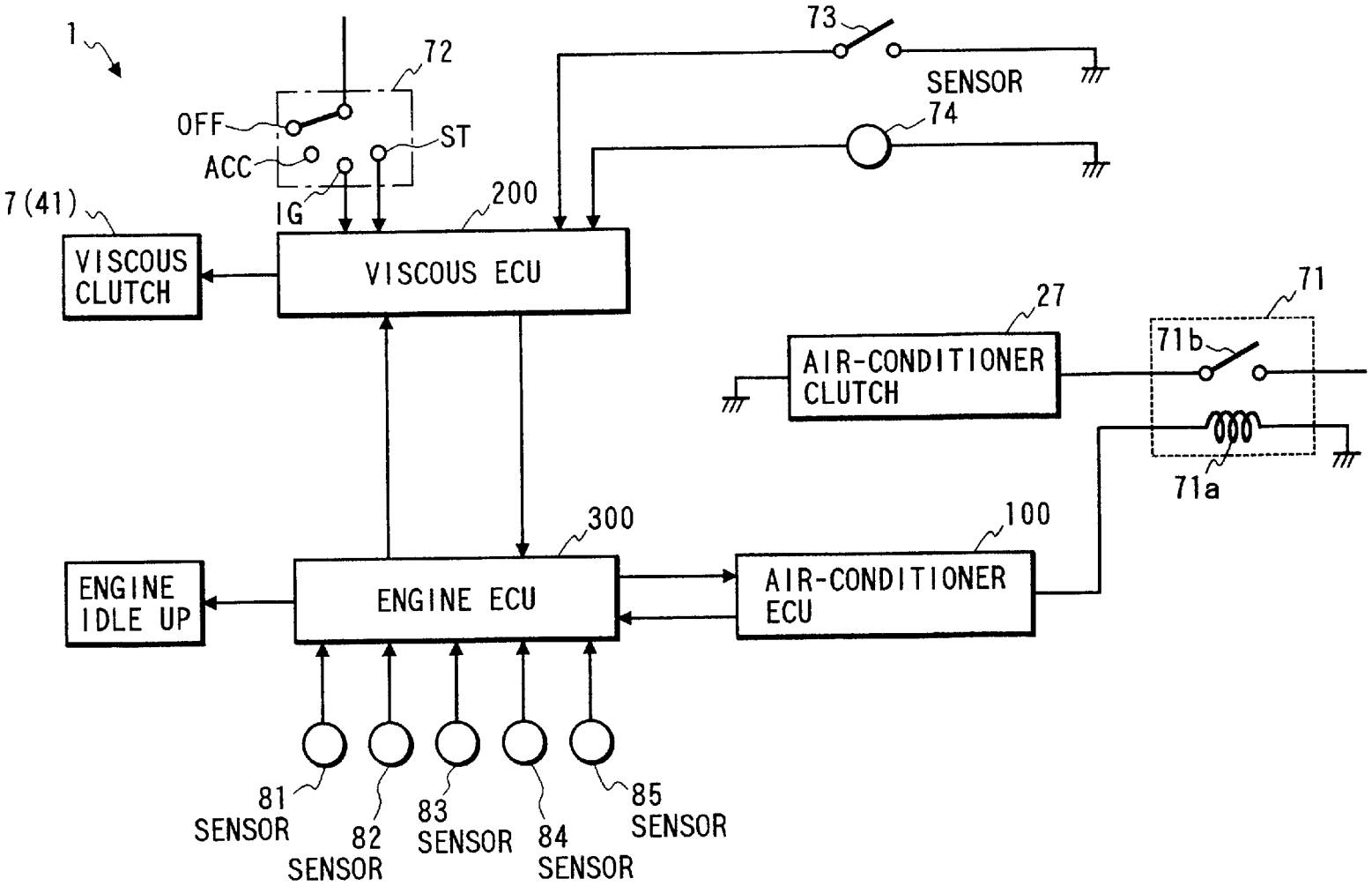
FIG. 5 is a diagram of an electric portion of the air conditioning system in FIG. 1.

With reference to FIG. 5, an air-conditioner ECU (electronic control unit) 100 includes a microcomputer or a similar device having a combination of an input/output port, a processing section, a ROM, and a RAM. The air-conditioner ECU 100 operates in accordance with a program stored in the ROM.

The air-conditioner ECU 100 receives output signals of various sensors (not shown) and an engine ECU (electronic control unit) 300, and generates control signals in response to the received signals according to the program. The air-conditioner ECU 100 outputs the generated control signals to the blower motors 23 and 33, the actuator for the air mix damper 28, and an air-conditioner clutch relay 71 to implement the control of conditioning air in the vehicle interior.

The air-conditioner clutch relay 71 has a winding 71*a* and a switch 71*b*. The relay switch 71*b* is closed when the relay winding 71*a* is energized. The relay switch 71*b* is opened when the relay winding 71*a* is de-energized. The relay winding 71*a* is connected to the air-conditioner ECU 100. The air-conditioner clutch 27 is electrically connected via the relay switch 71*b* to an electric power source (not shown). When the air-conditioner ECU 100 energizes the relay winding 71*a*, the relay switch 71*b* is closed so that the air-conditioner clutch 27 is activated by electric power. Thus, the air-conditioner clutch 27 falls into its engaged state (its on state). In this case, the compressor in the refrigeration cycle system is activated by the engine "E". When the air-conditioner ECU 100 de-energizes the relay winding 71*a*, the relay switch 71*b* is opened so that the air-conditioner clutch 27 is deactivated. Thus, the air-conditioner clutch 27 changes to its disengaged state (its off state). In this case, the compressor in the refrigeration cycle system is deactivated.

A viscous ECU (electronic control unit) 200 includes a microcomputer or a similar device having a combination of an input/output port, a processing section, a ROM, and a RAM. The viscous ECU 200 operates in accordance with a program stored in the ROM.

The viscous ECU 200 receives output signals of an engine ignition switch (an engine key switch) 72, a viscous switch 73, a fluid temperature sensor 74, and the engine ECU 300. The viscous ECU 200 generates a control signal in response to the received signals according to the program. The viscous ECU 200 outputs the generated control signal to the coil 41 of the viscous clutch 7 to implement the control of the viscous clutch 7.

The viscous switch 73 can be manually changed between an on position and an off position. When the viscous switch 73 is in its on position, the signal outputted from the viscous switch 73 to the viscous ECU 200 means a heating priority signal which requires priority to be given to the heating of the vehicle interior. When the viscous switch 73 is in its off position, the signal outputted from the viscous switch 73 to the viscous ECU 200 means a fuel-economy priority signal which requires priority to be given to fuel economy.

The engine ignition switch (the engine key switch) 72 has a movable contact, and fixed contacts "OFF", "ACC", "ST", and "IG". The movable contact of the engine ignition switch 72 can connect with any one of the fixed contacts "OFF", "ACC", "ST", and "IG" thereof. The fixed contacts "ST" and "IG" lead to the viscous ECU 200. When the movable contact of the engine ignition switch 72 connects with the fixed contact "ST" thereof, the signal outputted from the engine ignition switch 72 to the viscous ECU 200 means a signal (a starter activation signal) which requires a starter to be activated.

The fluid temperature sensor 74 includes, for example, a thermistor. The fluid temperature sensor 74 detects the temperature of the viscous fluid in the heating chamber 50 within the viscous heater 9. The signal outputted from the fluid temperature sensor 74 to the viscous ECU 200 indicates the detected temperature of the viscous fluid.

Figure 6:
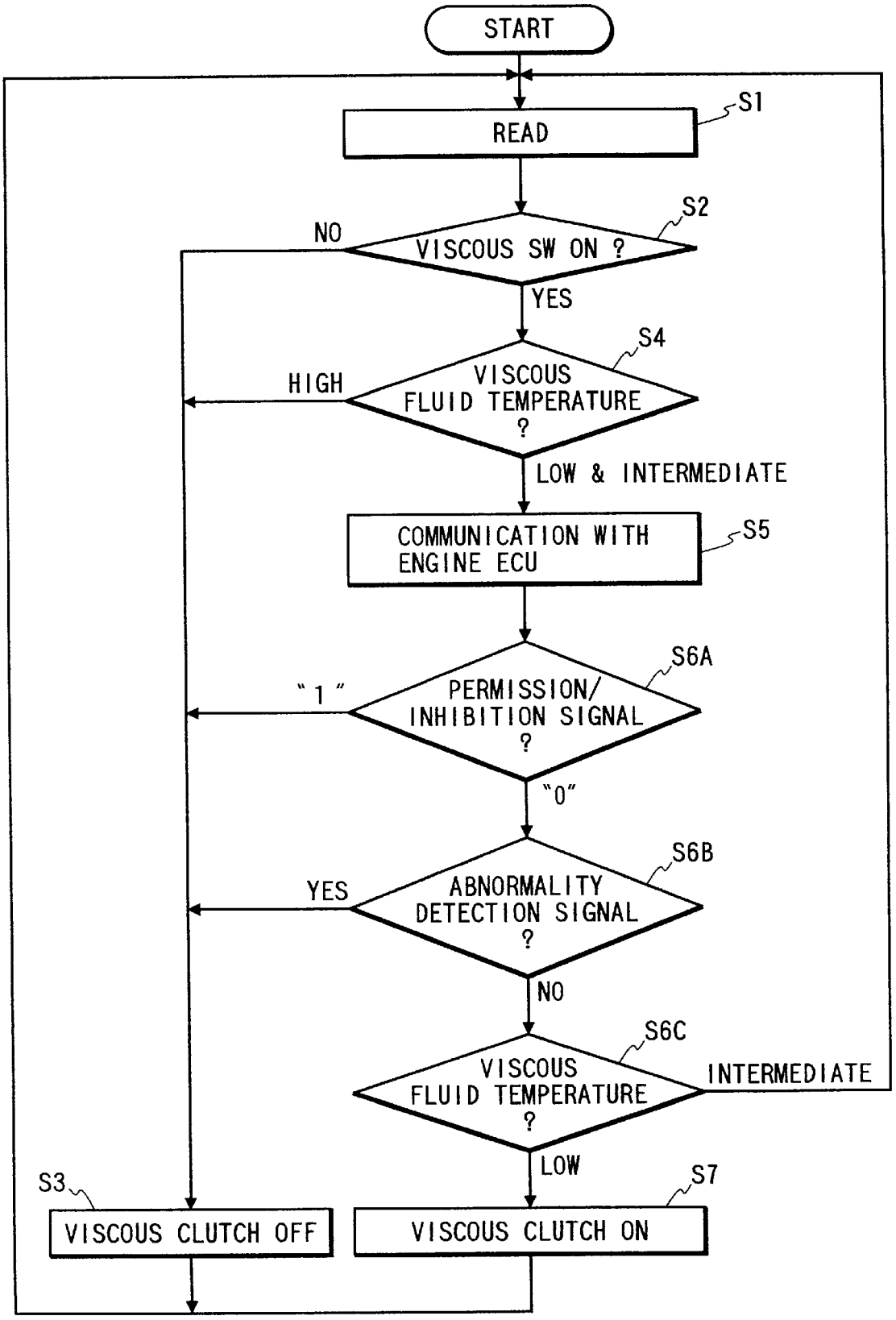
FIG. 6 is a flowchart of a program related to a viscous ECU (electronic control unit) in FIG. 5.

FIG. 6 is a flowchart of the program related to the viscous ECU 200. As shown in FIG. 6, a first step S1 of the program samples and reads the current states of the output signals of the viscous switch 73 and the fluid temperature sensor 74.

A step S2 following the step S1 decides whether or not the viscous switch 73 is in its on position, that is, whether or not the heating priority signal is present, by referring the current state of the output signal of the viscous switch 73. When it is decided that the viscous switch 73 is in its on position, that is, when the heating priority signal is present, the program advances from the step S2 to a step S4. Otherwise, the program advances from the step S2 to a step S3.

Figure 7:
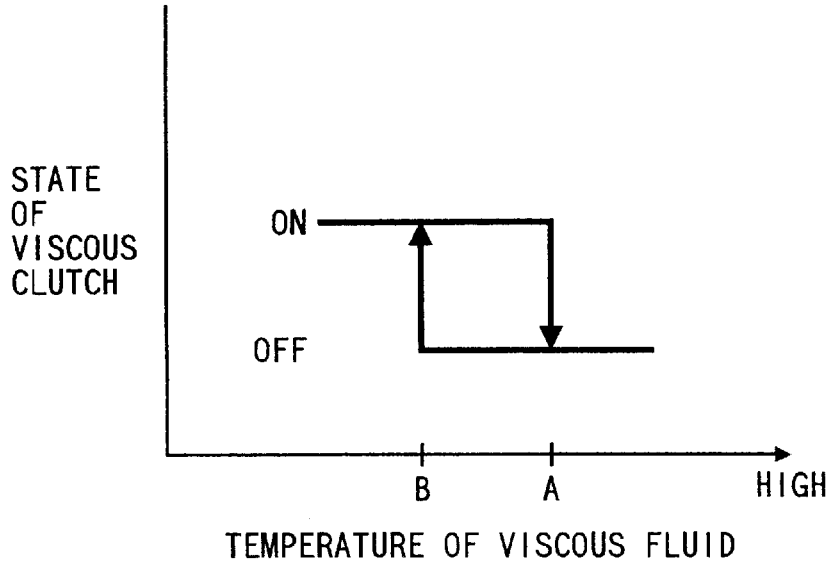
FIG. 7 is a diagram of a relation between the temperature of viscous fluid and the state of the viscous clutch in FIGS. 1, 3, and 4.

The step S4 derives the current temperature of the viscous fluid from the current state of the output signal of the fluid temperature sensor 74. The step S4 compares the current temperature of the viscous fluid with a predetermined high reference temperature "A" to decide whether or not the current temperature of the viscous fluid exists in a high range. For example, this decision is implemented by referring to a table (a map) which provides a predetermined relation between the temperature of the viscous fluid and the desired state of the viscous clutch 7. An example of this table is shown in FIG. 7. Information of this table is stored in the ROM within the viscous ECU 200. The table in FIG. 7 has a predetermined low reference temperature "B" in addition to the high reference temperature "A". The high reference temperature "A" is equal to, for example, 200° C. The low reference temperature "B" is equal to, for example, 180° C. The high reference temperature "A" corresponds to the boundary between the high range and an intermediate range. The low reference temperature "B" corresponds to the boundary between the intermediate range and a low range. When it is decided that the current temperature of the viscous fluid is equal to or higher than the high reference temperature "A", that is, when it is decided that the current temperature of the viscous fluid exists in the high range, the program advances from the step S4 to the step S3. When it is decided that the current temperature of the viscous fluid is lower than the high reference temperature "A", that is, when it is decided that the current temperature of the viscous fluid exists in the intermediate range or the low range, the program advances from the step S4 to a step S5.

As shown in FIG. 7, the predetermined relation between the temperature of the viscous fluid and the desired state of the viscous clutch 7, which is provided by the example of the table, has a hysteresis. It should be noted that the hysteresis may be omitted from the predetermined relation between the temperature of the viscous fluid and the desired state of the viscous clutch 7.

The step S5 implements communication with the engine ECU 300. Specifically, the step S5 informs the engine ECU 300 of whether or not the viscous clutch 7 is in its engaged state (its on state). The step S5 receives a permission/inhibition signal from the engine ECU 300. Also, the step S5 can receive an abnormality detection signal from the engine ECU 300. After the step S5, the program advances to a step S6A.

The step S6A decides whether the permission/inhibition signal received by the step S5 is "0" or "1". When it is decided that the permission/inhibition signal is "0", the program advances from the step S6A to a step S6B. When it is decided that the permission/inhibition signal is "1", the program advances from the step S6A to the step S3.

The step S6B decides whether or not an abnormality detection signal has been received from the engine ECU 300. When an abnormality detection signal has been received, the program advances from the step S6B to the step S3. Otherwise, the program advances from the step S6B to a step S6C.

The step S6C compares the current temperature of the viscous fluid with the low reference temperature "B" to decide whether the current temperature of the viscous fluid exists in the low range or the intermediate range. For example, this decision is implemented by referring to the table in FIG. 7. When it is decided that the current temperature of the viscous fluid is equal to or lower than the low reference temperature "B", that is, when it is decided that the current temperature of the viscous fluid exists in the low range, the program advances from the step S6C to a step S7. When it is decided that the current temperature of the viscous fluid is higher than the low reference temperature "B", that is, when it is decided that the current temperature of the viscous fluid exists in the intermediate range, the program returns from the step S6C to the step S1. The return of the program from the step S6C to the step S1 provides the hysteresis indicated in FIG. 7.

The step S7 energizes the coil 41 in the viscous clutch 7. Therefore, the viscous clutch 7 is changed to or held in its engaged position (its on position). In this case, the viscous heater 9 is activated. After the step S7, the program returns to the step S1.

The step S3 de-energizes the coil 41 in the viscous clutch 7. Therefore, the viscous clutch 7 is changed to or held in its disengaged position (its off position). In this case, the viscous heater 9 is deactivated. After the step S3, the program returns to the step S1.

With reference back to FIG. 5, the engine ECU 300 includes a microcomputer or a similar device having a combination of an input/output port, a processing section, a ROM, and a RAM. The engine ECU 300 operates in accordance with a program stored in the ROM.

The engine ECU 300 receives output signals of an engine speed sensor 81, a vehicle speed sensor 82, a throttle position sensor (or an accelerator pedal position sensor) 83, an engine coolant temperature sensor 84, a pickup sensor 85, the air-conditioner ECU 100, and the viscous ECU 200. The engine ECU 300 generates control signals in response to the received signals according to the program. The engine ECU 300 outputs the generated control signals to respective engine control devices to implement the engine idle speed control (for example, the engine idle up control), the fuel injection rate control, the fuel injection timing control, the air throttle control, and the glow plug control. In addition, the engine ECU 300 can generate a permission/inhibition signal and an abnormality detection signal in response to the received signals according to the program. The engine ECU 300 outputs the permission/inhibition signal and the abnormality detection signal to the viscous ECU 200. The permission/inhibition signal can change between "0" and "1". The permission/inhibition signal being "0" causes the viscous ECU 200 to energize the coil 41 in the viscous clutch 7. The permission/inhibition signal being "1" causes the viscous ECU 200 to de-energize the coil 41 in the viscous clutch 7. Also, the abnormality detection signal causes the viscous ECU 200 to de-energize the coil 41 in the viscous clutch 7 regardless of the state of the permission/inhibition signal. Furthermore, the engine ECU 300 can generate a permission signal in response to the received signals according to the program. The engine ECU 300 outputs the permission signal to the air-conditioner ECU 100. The permission signal allows the air-conditioner ECU 100 to energize the winding 71*a* of the air-conditioner clutch relay 71.

The engine speed sensor 81 is a first physical quantity detecting device. The engine speed sensor 81 detects the rotational speed of the crankshaft 11 of the engine "E". The engine speed sensor 81 outputs a signal to the engine ECU 300 which represents the detected rotational speed of the crankshaft 11 of the engine "E".

The vehicle speed sensor 82 is of a reed switch type, a photoelectric type, or a magnetoresistive type. The vehicle speed sensor 82 detects the speed of the vehicle body. The vehicle speed sensor 82 outputs a signal to the engine ECU 300 which represents the detected speed of the vehicle body.

The throttle position sensor 83 is associated with a throttle valve movably disposed in an air induction passage of the engine "E". The throttle position sensor 83 detects the position of the throttle valve, that is, the degree of opening of the throttle valve. The throttle position sensor 83 outputs a signal to the engine ECU 300 which represents the detected position of the throttle valve or the detected degree of opening of the throttle valve. It should be noted that the throttle position sensor 83 may be replaced by an accelerator pedal position sensor.

The engine coolant temperature sensor 84 includes, for example, a thermistor. The engine coolant temperature sensor 84 detects the temperature of the engine coolant in the coolant circuit 2. The engine coolant temperature sensor 54 is located at, for example, the outlet of the water jacket 13 in the engine "E" or the outlet 57*b* of the viscous heater 9. The engine coolant temperature sensor 84 outputs a signal to the engine ECU 300 which represents the detected temperature of the engine coolant.

Figure 8:
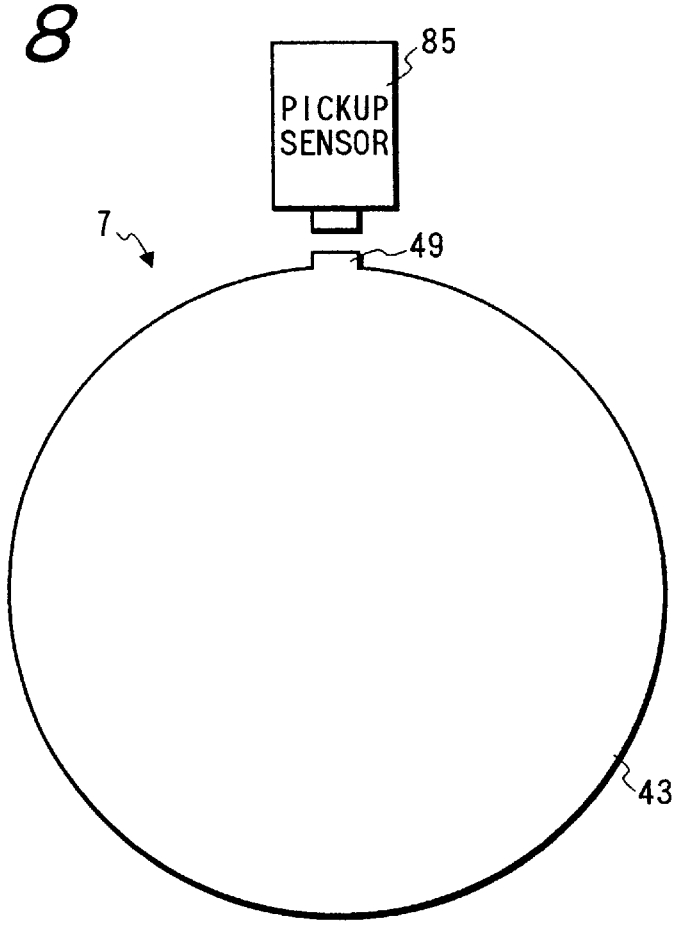
FIG. 8 is a diagram of an armature in the viscous clutch and a pickup sensor in FIG. 5.

The pickup sensor 85 is a second physical quantity detecting device. As shown in FIG. 8, the pickup sensor 85 is located at a position radially outward of the armature 43 of the viscous clutch 7. The outer circumferential surfaces of the armature 43 has one or more projections 49. The pickup sensor 85 cooperates with the projection 49. During rotation of the armature 43, the pickup sensor 85 outputs one electric pulse each time the projection 49 passes a position opposing the pickup sensor 85. The pickup sensor 85 detects the rotational speed of the armature 43. It should be noted that the rotational speed of the armature 43 in the viscous clutch 7 is equal to the rotational speed of the drive shaft 8 or the rotor 53 in the viscous heater 9. The pickup sensor 85 outputs a signal to the engine ECU 300 which represents the detected rotational speed of the armature 43 (or the rotor 53).

It should be noted that the pickup sensor 85 may be replaced by a speed sensor associated with the drive shaft 8 or the rotor 53 in the viscous heater 9 for detecting the rotational speed of the drive shaft 8 or the rotor 53.

Figure 9:
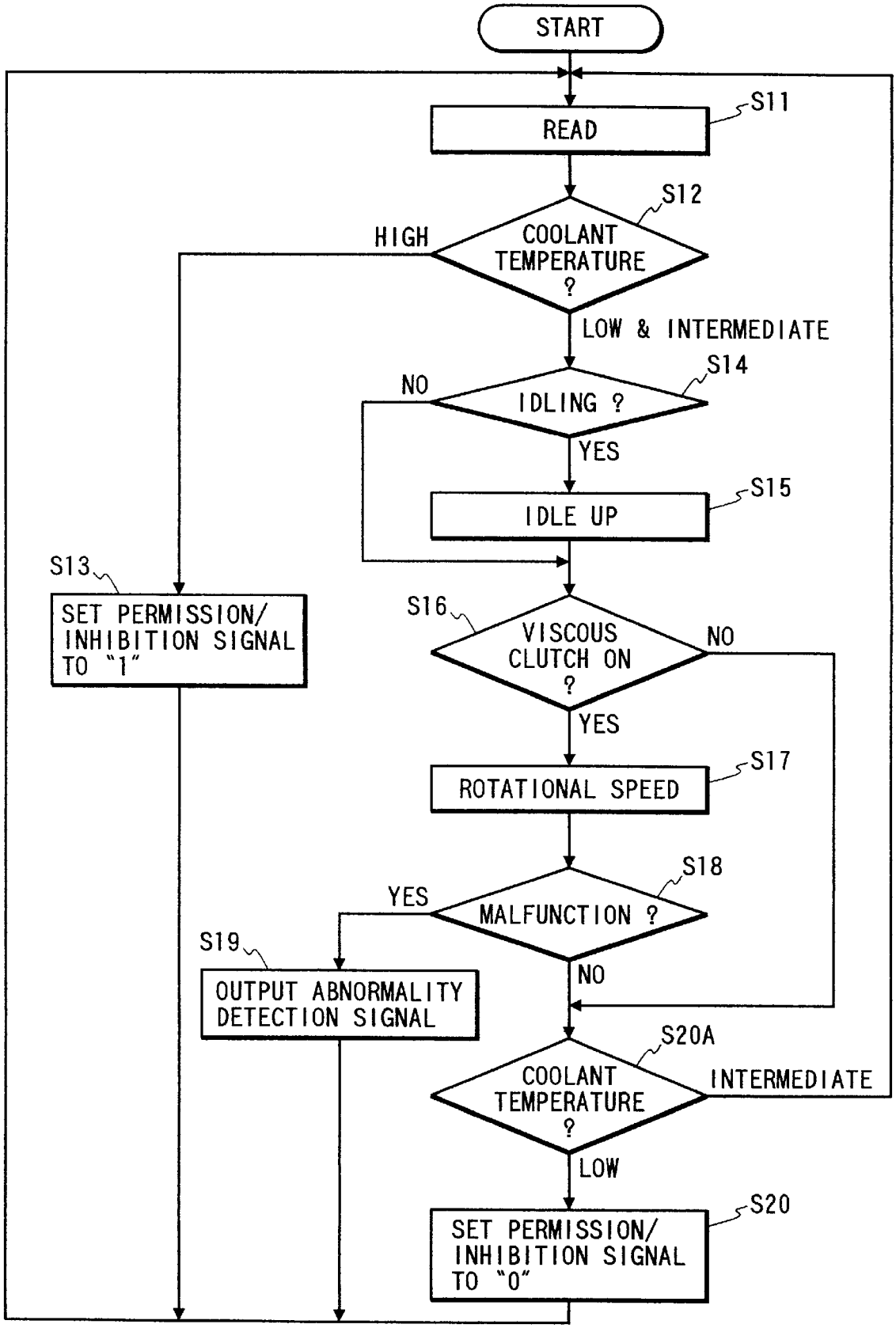
FIG. 9 is a flowchart of a segment of a program related to an engine ECU (electronic control unit) in FIG. 5.

FIG. 9 is a flowchart of a segment of the program related to the engine ECU 300. The program segment in FIG. 9 is designed to generate and output a permission/inhibition signal and an abnormality detection signal.

As shown in FIG. 9, a first step S11 of the program segment samples and reads the current states of the output signals of various sensors and switches including the engine speed sensor 81, the vehicle speed sensor 82, the throttle position sensor (or the accelerator pedal position sensor) 83, the engine coolant temperature sensor 84, and the pickup sensor 85. Also, the step S11 receives information from the viscous ECU 200 which represents whether or not the viscous clutch 7 is in its engaged state (its on state).

Figure 10:
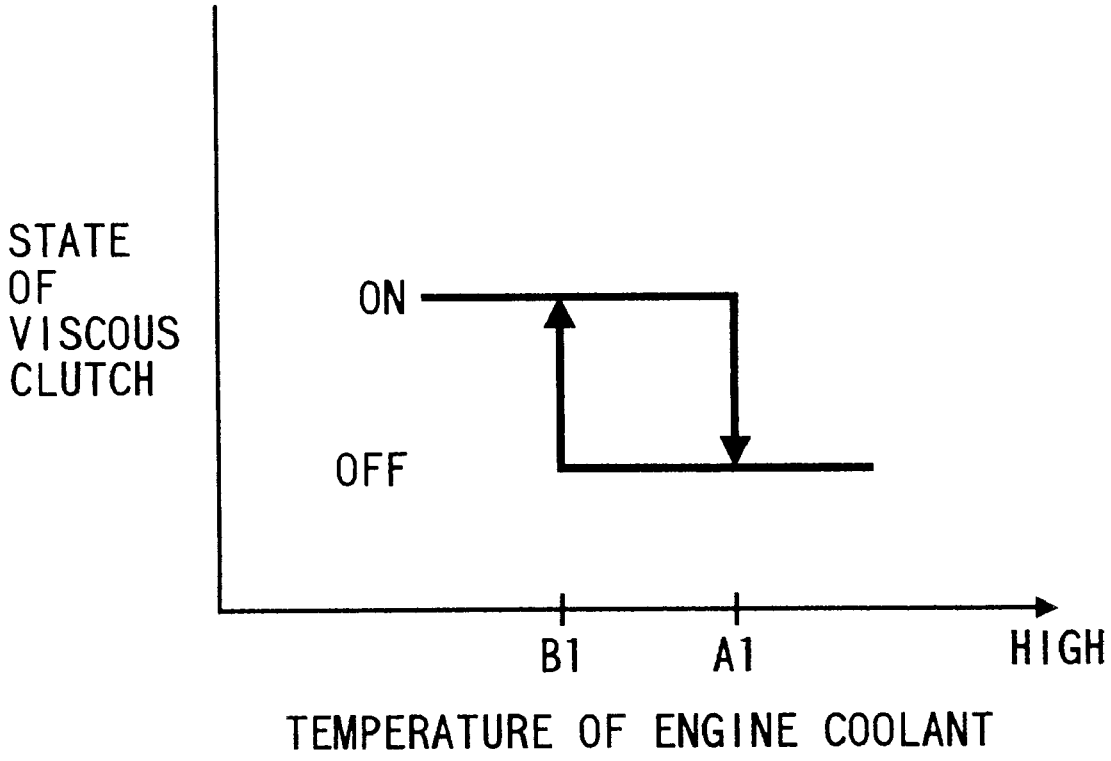
FIG. 10 is a diagram of a relation between the temperature of engine coolant and the state of the viscous clutch in FIGS. 1, 3, and 4.

A step S12 following the step S1 derives the current temperature of the engine coolant from the current state of the output signal of the engine coolant temperature sensor 84. The step S12 compares the current temperature of the engine coolant with a predetermined high reference temperature "A1" to decide whether or not the current temperature of the engine coolant exists in a high range. For example, this decision is implemented by referring to a table (a map) which provides a predetermined relation between the temperature of the engine coolant and the desired state of the viscous clutch 7. An example of this table is shown in FIG. 10. Information of this table is stored in the ROM within the engine ECU 300. The table in FIG. 10 has a predetermined low reference temperature "B1" in addition to the high reference temperature "A1". The high reference temperature "A1" is equal to, for example, 80° C. The low reference temperature "B1" is equal to, for example, 70° C. The high reference temperature "A1" corresponds to the boundary between the high range and an intermediate range. The low reference temperature "B1" corresponds to the boundary between the intermediate range and a low range. When it is decided that the current temperature of the engine coolant is equal to or higher than the high reference temperature "A1", that is, when it is decided that the current temperature of the engine coolant exists in the high range, the program advances from the step S12 to a step S13. When it is decided that the current temperature of the engine coolant is lower than the high reference temperature "A1", that is, when it is decided that the current temperature of the engine coolant exists in the low range or the intermediate range, the program advances from the step S12 to a step S14.

As shown in FIG. 10, the predetermined relation between the temperature of the engine coolant and the desired state of the viscous clutch 7, which is provided by the example of the table, has a hysteresis. It should be noted that the hysteresis may be omitted from the predetermined relation between the temperature of the engine coolant and the desired state of the viscous clutch 7.

The step S14 decides whether or not the engine "E" is idling by referring to the current states of the output signals of the throttle position sensor (or the accelerator pedal position sensor) 83 and the engine speed sensor 81. When it is decided that the engine "E" is idling, the program advances from the step S14 to a step S15. Otherwise, the program jumps from the step S14 to a step S16.

The step S15 implements the engine idle up control. After the step S15, the program advances to the step S16.

The step S16 decides whether or not the viscous clutch 7 is in its engaged state (its on state) by referring to the information fed from the viscous ECU 200. When it is decided that the viscous clutch 7 is in its engaged state (its on state), the program advances from the step S16 to a step S17. Otherwise, the program jumps from the step S16 to a step S20A.

The step S17 derives the current rotational speed of the engine "E" from the output signal of the engine speed sensor 81. Also, the step S14 derives the current rotational speed of the armature 43 (or the rotor 53) from the output signal of the pickup sensor 85.

A step S18 subsequent to the step S17 decides whether or not the viscous heater 9 is operating normally, that is, whether or not a malfunction of the viscous heater 9 occurs. An example of the malfunction is the locking of the drive shaft 8 or the rotor 53 in the viscous heater 9. Specifically, the step S18 calculates a ratio between the current rotational speed of the engine "E" and the current rotational speed of the armature 43 (or the rotor 53) which are a first physical quantity and a second physical quantity respectively. The step S18 decides whether or not the calculated ratio is in a predetermined normal range. When it is decided that the calculated ratio is in the predetermined normal range, that is, when it is decided that the viscous heater 9 is operating normally, the program advances from the step S18 to the step S20A. When it is decided that the calculated ratio is outside the predetermined normal range, that is, when it is decided that a malfunction of the viscous heater 9 occurs, the program advances from the step S18 to a step S19.

For example, the step S18 decides whether or not the current rotational speed of the armature 43 (or the rotor 53) is higher than a half of the current rotational speed of the engine "E". When it is decided that the current rotational speed of the armature 43 (or the rotor 53) is higher than a half of the current rotational speed of the engine "E", that is, when it is decided that the viscous heater 9 is operating normally, the program advances from the step S18 to the step S20A. When it is decided that the current rotational speed of the armature 43 (or the rotor 53) is equal to or lower than a half of the current rotational speed of the engine "E", that is, when it is decided that a malfunction of the viscous heater 9 occurs, the program advances from the step S18 to the step S19.

The step S20A compares the current temperature of the engine coolant with the low reference temperature "B1" to decide whether the current temperature of the engine coolant exists in the low range or the intermediate range. For example, this decision is implemented by referring to the table in FIG. 10. When it is decided that the current temperature of the engine coolant is equal to or lower than the low reference temperature "B1", that is, when it is decided that the current temperature of the engine coolant exists in the low range, the program advances from the step S20A to a step S20. When it is decided that the current temperature of the engine coolant is higher than the low reference temperature "B1", that is, when it is decided that the current temperature of the engine coolant exists in the intermediate range, the program returns from the step S20A to the step S11. The return of the program from the step S20A to the step S11 provides the hysteresis indicated in FIG. 10.

The step S13 sets a permission/inhibition signal to "1". The step S13 outputs the permission/inhibition signal being "1" to the viscous ECU 200. The permission/inhibition signal being "1" causes the viscous ECU 200 to change the viscous clutch 7 to its disengaged state (its off state) or to hold the viscous clutch 7 in its disengaged state (its off state). Accordingly, the viscous heater 9 is deactivated. After the step S13, the program returns to the step S11.

The step S19 generates an abnormality detection signal. The step S19 outputs the abnormality detection signal to the viscous ECU 200. The abnormality detection signal causes the viscous ECU 200 to change the viscous clutch 7 to its disengaged state (its off state) even when the permission/inhibition signal is "0". Accordingly, the viscous heater 9 is deactivated. After the step S19, the program returns to the step S11.

The step S20 sets a permission/inhibition signal to "0". The step S20 outputs the permission/inhibition signal being "0" to the viscous ECU 200. Normally, the permission/inhibition signal being "0" causes the viscous ECU 200 to change the viscous clutch 7 to its engaged state (its on state) or to hold the viscous clutch 7 in its engaged state (its on state). Accordingly, the viscous heater 9 is activated in the absence of a malfunction of the viscous heater 9. After the step S20, the program returns to the step S11.

The air conditioning system 1 operates as follows. When the engine "E" starts, the crankshaft 11 of the engine "E" rotates. The V belt 6 moves in accordance with the rotation of the crankshaft 11. The rotor 42 in the viscous clutch 7 rotates as the V belt 6 moves. It is assumed that the viscous switch 73 is changed to its on position. In the case where the temperature of the engine coolant is relative low and the engine ECU 300 feeds the viscous ECU 200 with a permission/inhibition signal being "0", the viscous ECU 200 energizes the coil 41 of the viscous clutch 7. In the viscous clutch 7, the frictional surface of the armature 43 is moved by the coil 41 into engagement with the frictional surface of the rotor 42. Thus, the viscous clutch 7 is changed to its engaged state (its on state). Accordingly, the drive shaft 8 of the viscous heater 9 is coupled to the crankshaft 11 of the engine "E". In this case, the drive shaft 8 rotates in accordance with the rotation of the crankshaft 11.

In the viscous heater 9, the rotor 53 rotates together with the drive shaft 8. The rotor 53 applies shear forces to the viscous fluid in the heating chamber 50 while rotating. The viscous fluid is heated by the applied shear forces. Therefore, the engine coolant is heated when flowing through the coolant chamber 51 in the viscous heater 9. The heated engine coolant is fed from the viscous heater 9 to the front-side heater core 15. The heated engine coolant can also be fed from the viscous heater 9 to the rear-side heater core 16. Accordingly, the vehicle interior is heated by an increased heating power.

While the viscous clutch 7 remains in its engaged state (its on state), the engine ECU 300 periodically checks whether or not a malfunction of the viscous heater 9 occurs. An example of the malfunction is the locking of the rotor 53 in the viscous heater 9. When the rotor 53 locks, the rotational speed of the armature 43 in the viscous clutch 7 tends to considerably drop relative to the rotational speed of the crankshaft 11 of the engine "E". In this case, the rotor 42 of the viscous clutch 7 slides relative to the armature 43 while receives a frictional force therefrom. The engine ECU 300 detects the occurrence of a malfunction of the viscous heater 9 in response to the considerable drop in the rotational speed of the armature 43. When the engine ECU 300 detects the occurrence of a malfunction of the viscous heater 9, the engine ECU 300 outputs an abnormality detection signal to the viscous ECU 200. The viscous ECU 200 de-energizes the coil 41 of the viscous clutch 7 in response to the abnormality detection signal regardless of the state of the permission/inhibition signal. In the viscous clutch 7, the frictional surface of the armature 43 is moved out of engagement with the frictional surface of the rotor 42. Thus, the viscous clutch 7 is changed to its disengaged state (its off state). Accordingly, the drive shaft 8 of the viscous heater 9 is uncoupled from the crankshaft 11 of the engine "E". Thus, in the event of a malfunction of the viscous heater 9, it is possible to prevent the rotor 42 and the armature 43 in the viscous clutch 7 from seizing up or being damaged. Also, it is possible to prevent the V belt 6 from being damage.

It should be noted that the cooling portion may be omitted from the air conditioning system 1. In this case, the air conditioning system 1 serves as a heating system for the vehicle interior.

Second Embodiment

A second embodiment of this invention is similar to the first embodiment thereof except for design changes indicated hereinafter.

Figure 11:
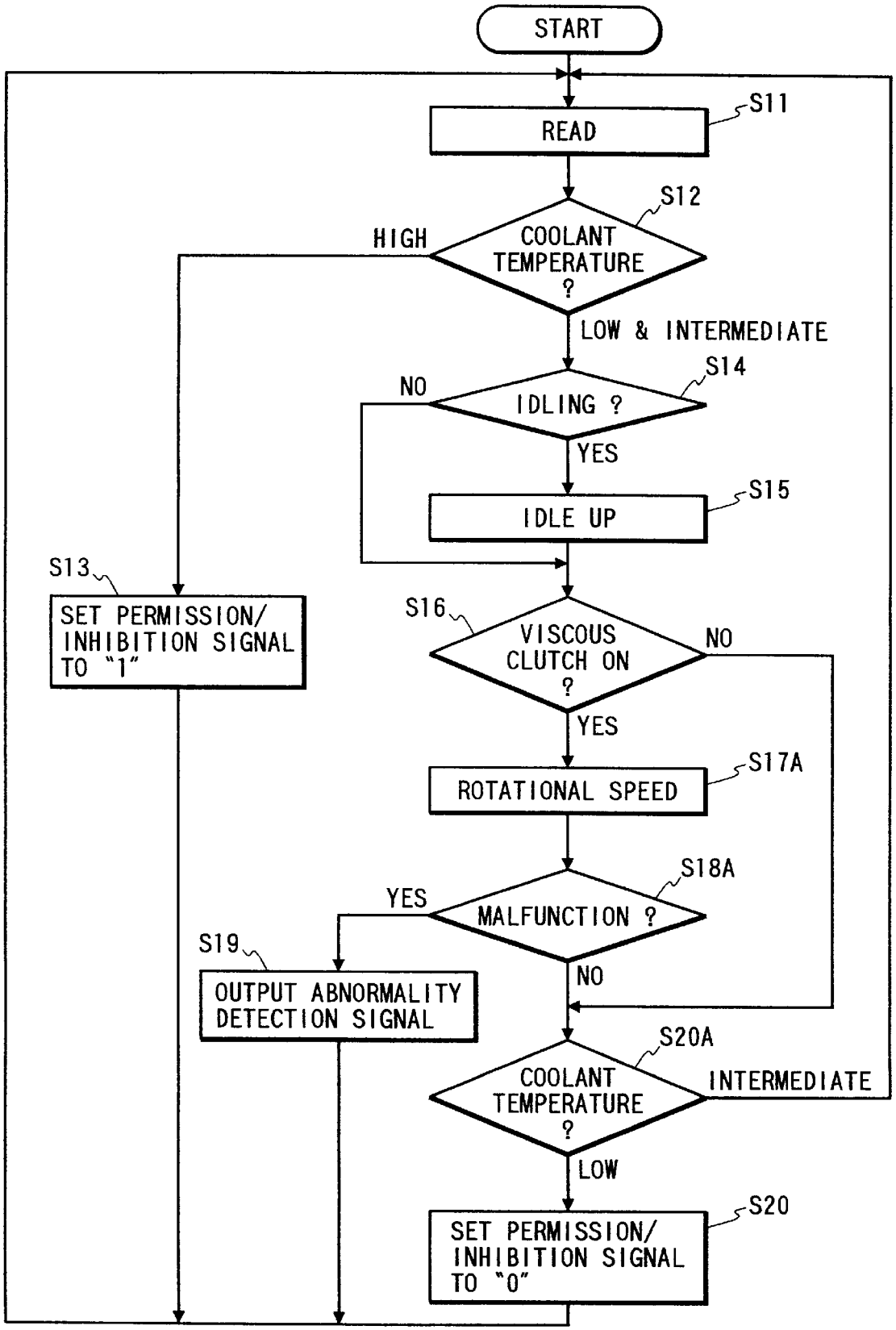
FIG. 11 is a flowchart of a segment of a program related to an engine ECU (electronic control unit) in a second embodiment of this invention.

FIG. 11 is a flowchart of a segment of a program related to the engine ECU 300 (see FIG. 5) in the second embodiment of this invention. The program segment in FIG. 11 is similar to the program segment in FIG. 9 except that steps S17A and S18A replace the steps S17 and S18 respectively.

With reference to FIG. 11, the step S17A derives the current rotational speed of the armature 43 (see FIG. 3) from the output signal of the pickup sensor 85 (see FIG. 5).

The step S18A which follows the step S17A decides whether or not the viscous heater 9 is operating normally, that is, whether or not a malfunction of the viscous heater 9 occurs. Specifically, the step S18A compares the current rotational speed of the armature 43 (see FIG. 3) with a predetermined reference speed to implement the above-mentioned decision. The predetermined reference speed is equal to, for example, 650 rpm. When the current rotational speed of the armature 43 (see FIG. 3) is higher than the predetermined reference speed, that is, when it is decided that the viscous heater 9 is operating normally, the program advances from the step S18A to the step S20A. When the current rotational speed of the armature 43 (see FIG. 3) is equal to or lower than the predetermined reference speed, that is, when it is decided that a malfunction of the viscous heater 9 occurs, the program advances from the step S18A to the step S19.

Third Embodiment

Figure 12:
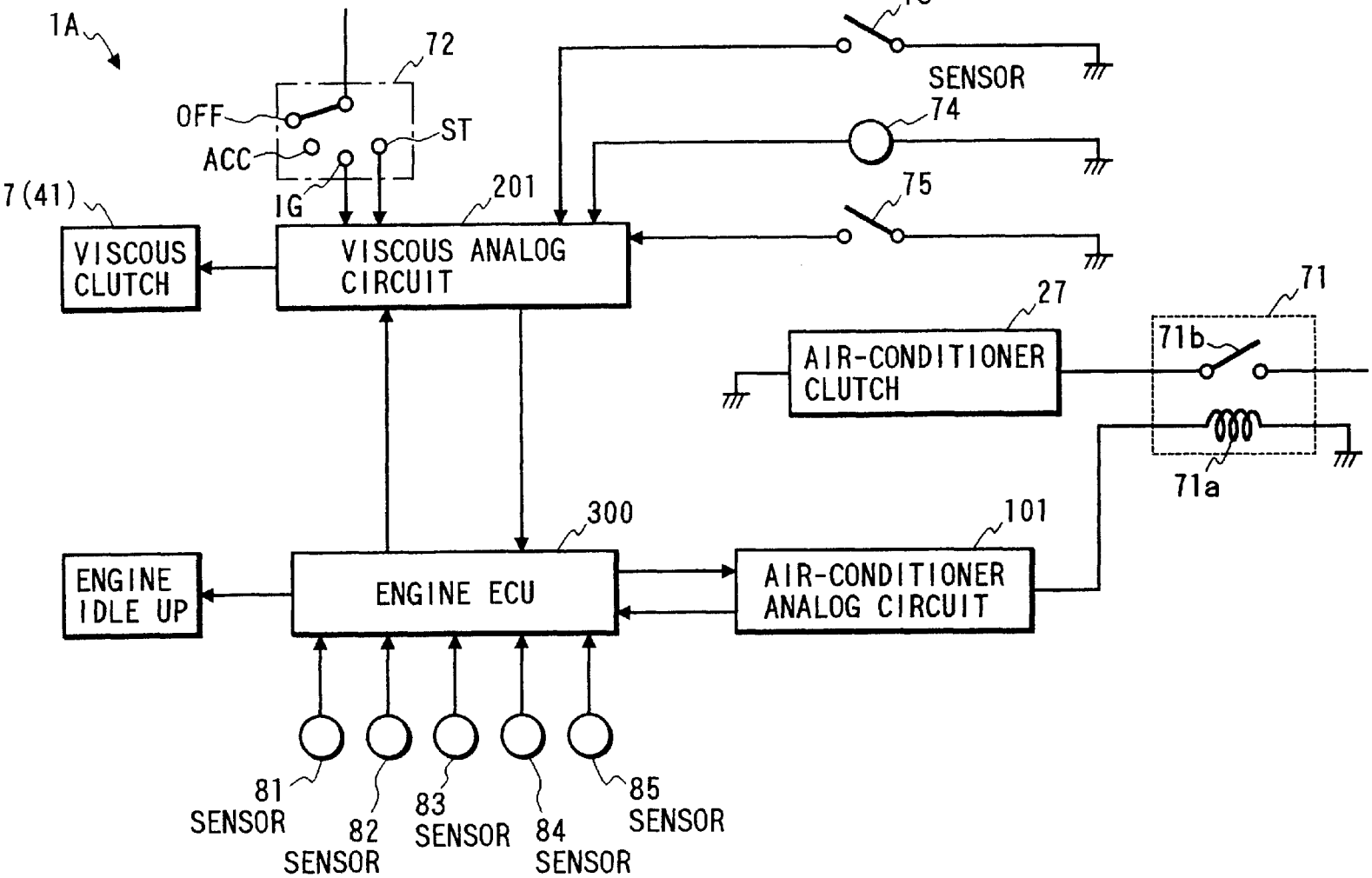
FIG. 12 is a diagram of an electric portion of an air conditioning system for a vehicle interior which includes a heating apparatus according to a third embodiment of this invention.

FIG. 12 shows an electric portion of an air conditioning system 1A for a vehicle interior according to a third embodiment of this invention. The air conditioning system 1A in FIG. 12 is similar to the air conditioning system 1 in FIG. 5 except for design changes indicated hereinafter.

The air conditioning system 1A includes an air-conditioner analog circuit 101 instead of the air-conditioner ECU 100 (see FIG. 5). The air-conditioner analog circuit 101 serves to control the air conditioner 3 (see FIG. 1). The air conditioning system 1A includes a viscous analog circuit 201 instead of the viscous ECU 200 (see FIG. 5). The viscous analog circuit 201 serves to control the viscous clutch 7.

The air-conditioner analog circuit 101 has an input section which is connected to the engine ECU 300 and various sensors. The air-conditioner analog circuit 101 has an output section which is connected to the engine ECU 300 and cooling/heating adjustment devices such as the blower motors 23 and 33 (see FIG. 1) and the winding 71*a* of the air-conditioner clutch relay 71.

The viscous analog circuit 201 has an input section which is connected to the fixed contacts "ST" and "IG" of the engine ignition switch (the engine key switch) 72, the viscous switch 73, the fluid temperature sensor 74, a lock switch 75, and the engine ECU 300. The viscous analog circuit 201 has an output section which is connected to the engine ECU 300 and the coil 41 in the viscous clutch 7.

The lock switch 75 is a physical quantity detecting device. The lock switch 75 is open when the rotational speed of the armature 43 (see FIG. 3) in the viscous clutch 7 or the rotational speed of the rotor 53 in the viscous heater 9 (see FIG. 3) is higher than a predetermined reference speed. The lock switch 75 is closed when the rotational speed of the armature 43 (see FIG. 3) in the viscous clutch 7 or the rotational speed of the rotor 53 in the viscous heater 9 (see FIG. 3) is equal to or lower than the predetermined reference speed. The predetermined reference speed is equal to, for example, 650 rpm. Accordingly, the lock switch 75 is closed when a malfunction of the viscous heater 9 (see FIG. 3) occurs. Otherwise, the lock switch 75 is open.

The engine ECU 300 generates a permission/inhibition signal in response to the output signals of the engine speed sensor 81, the vehicle speed sensor 82, the throttle position sensor (or the accelerator pedal position sensor) 83, the coolant temperature sensor 84, and the pickup sensor 85 by implementing calculation steps, processing steps, and decision steps which are similar to those in the first embodiment or the second embodiment of this invention. The engine ECU 300 outputs the generated permission/inhibition signal to the viscous analog circuit 201.

As in the first embodiment or the second embodiment of this invention, the engine ECU 300 may decide whether or not a malfunction of the viscous heater 9 occurs. In this case, the engine ECU 300 outputs an abnormality detection signal to the viscous analog circuit 201 when a malfunction of the viscous heater 9 occurs.

Even in the case where the viscous switch 73 is in its on position, when the lock switch 75 is closed, the viscous analog circuit 201 de-energizes the coil 41 in the viscous clutch 7 in response to the output signal of the lock switch 75 to uncouple the viscous heater 9 (see FIG. 3) from the engine "E" (see FIG. 1). Thus, in the event of a malfunction of the viscous heater 9 (see FIG. 3), it is possible to prevent the V belt 6 (see FIGS. 1 and 2) and the viscous clutch 7 from being damaged.

Other Embodiments

Each of the first, second, and third embodiments of this invention may be modified into a structure having an additional power transmission device provided between the crankshaft 11 of the engine "E" and the viscous clutch 7, or between the viscous clutch 7 and the drive shaft 8 of the viscous heater 9. An example of the additional power transmission device is a speed change gearbox or a belt-based continuously variable transmission.

In each of the first, second, and third embodiments of this invention, the viscous clutch (the electromagnetic clutch) 7 may be replaced by a hydraulic multiple-disc clutch.

In each of the first, second, and third embodiments of this invention, the V belt 6 may be replaced by a chain or another belt.

Each of the first, second, and third embodiments of this invention may be modified into a structure in which the viscous clutch 7 is removed, and the drive shaft 8 of the viscous heater 9 is connected to the crankshaft 11 of the engine "E" via a belt-based continuously variable transmission. In this case, the ratio between the effective diameters of an input pulley and an output pulley of the belt-based continuously variable transmission is chosen to minimize a load on the engine "E" when the viscous heater 9 is activated.

What is claimed is:

1. A heating apparatus for a vehicle, comprising:

(a) a heat exchanger for implementing heat exchange between coolant which has cooled an engine and air directed to a vehicle interior to heat the vehicle interior;

(b) a viscous heater including a rotor and a heating chamber containing viscous fluid, the rotor rotating when receiving a drive force from the engine, the viscous fluid being subjected to a shear force and being heated when the rotor is subjected to the drive force, the viscous heater heating the coolant fed to the heat exchanger as the viscous fluid in the heating chamber is heated;

(c) a clutch for selectively permitting and inhibiting transmission of the drive for from the engine to the rotor;

(d) a belt transmission device connecting the engine and the clutch;

(e) rotational speed detecting means or detecting a rotational speed of the rotor; and (f) control means for controlling the clutch to inhibit the transmission of the drive force from the engine to the rotor when the rotational speed detected by the rotational speed detecting means is equal to or less than a predetermined value.

2. A heating apparatus as recited in claim 1, wherein the belt transmission device comprises a belt for transmitting the drive force to the rotor of the viscous heater and engine-driven devices including an alternator, a pump, a blower, and a compressor.

3. A heating apparatus for a vehicle, comprising:

(a) a heat exchanger for implementing heat exchange between coolant which has cooled an engine and air directed to a vehicle interior to heat the vehicle interior;

(b) a viscous heater including a rotor and a heating chamber containing viscous fluid, the rotor rotating when being subjected to rotational power of the engine, the viscous fluid being subjected to a shear force and being heated when the rotor is subjected to the rotational power, the viscous heater heating the coolant fed to the heat exchanger as the viscous fluid in the heating chamber is heated;

(c) a clutch for selectively permitting and inhibiting transmission of the rotational power from the engine to the rotor;

(d) a belt transmission device connecting the engine and the clutch;

(e) first rotational speed detecting means for detecting a rotational speed of the engine;

(f) second rotational speed detecting means for detecting a rotational speed of the rotor; and (g) control means far controlling the clutch to inhibit the transmission of the rotational power form the engine to the rotor when a difference between the rotational speed detected by the first rotational speed detecting means and the rotational speed detected by the second roational speed detecting means is greater than a predetermined value.

4. A heating apparatus as recited in claim 3, wherein the belt transmission device comprises a belt for transmitting the rotational power to the rotor of the viscous heater and engine-driven devices including an alternator, a pump, a blower, and a compressor.

5. A heating apparatus as recited in claim 1, wherein the rotor rotates when being subjected to a rotational power of the engine.

6. A heating apparatus as recited in claim 5, wherein the engine comprises a rotatable output shaft for transmitting the drive force, and the rotor of the viscous heater comprises a rotatable drive shaft for receiving the drive force, said control means controlling the clutch to inhibit the transmission of the drive force from the rotatable output shaft to the rotatable drive shaft when the rotational speed detected by the rotational speed detecting means is equal to or less than said predetermined value.

7. A heating apparatus as recited in claim 5, wherein the rotor of the viscous heater comprises a rotatable drive shaft for receiving the drive force and said control means controlling the clutch to inhibit the transmission of drive force to the rotatable drive shaft when the rotational speed of the rotatable drive shaft is equal to or less than the predetermined value.

8. A heating apparatus for a vehicle, comprising:

(a) a heat exchanger for implementing heat exchange between coolant which has cooled a drive source and air directed to a vehicle interior to heat the vehicle interior;

(b) a viscous heater including a rotor and a heating chamber containing viscous fluid, the rotor rotating when receiving a drive force from the drive source, the viscous fluid being subjected to a shear force and being heated when the rotor is subjected to the drive force, the viscous heater heating the coolant fed to the heat exchanger as the viscous fluid in the heating chamber is heated;

(c) a clutch for selectively permitting and inhibiting transmission of the drive force from the drive source to the rotor;

(d) a belt transmission device connecting the drive source and the clutch;

(e) rotational speed detecting means or detecting a rotational speed of the rotor; and (f) control means for controlling the clutch to inhibit the transmission of the drive force from the drive source to the rotor when the rotational speed detected by the rotational speed detecting means is equal to or less than a predetermined value.

9. A heating apparatus for a vehicle, comprising:

(a) a heat exchanger for implementing heat exchange between coolant which has cooled a drive source and air directed to a vehicle interior to heat the vehicle interior;

(b) a viscous heater including a rotor and a heating chamber containing viscous fluid, the rotor rotating when being subjected to rotational power of the drive source, the viscous fluid being subjected to a shear force and being heated when the rotor is subjected to the rotational power, the viscous heater heating the coolant fed to the heat exchanger as the viscous fluid in the heating chamber is heated;

(c) a clutch for selectively permitting and inhibiting transmission of the rotational power from the drive source to the rotor;

(d) a belt transmission device connecting the drive source and the clutch;

(e) first rotational speed detecting means for detecting a rotational speed of the drive source;

(f) second rotational speed detecting means for detecting a rotational speed of the rotor; and (g) control means for controlling the clutch to inhibit the transmission of the rotational power from the drive source to the rotor when a difference between the rotational speed detected by the first rotational speed detecting means and the rotational speed detected by the second rotational speed detecting means is greater than a predetermined value.

* * * * *

UNITED STATES PATENT AND TRADEMARK OFFICE

CERTIFICATE OF CORRECTION

PATENT NO. : 5,897,056

DATED : April 27, 1999

INVENTOR(S) : Toshio Morikawa et al

It is certified that error appears in the above-identified patent and that said Letters Patent is hereby corrected as shown below:

Col. 9, line 17, delete "ally" and substitute --alloy-- therefor

Col. 14, line 1, "S1" should be --S11--

Col. 16, line 40, delete "receives" and substitute --receiving-- therefor

Col. 16, line 58, delete "damage" and substitute --damaged-- therefor

Col. 18, line 66, claim 1, "for" should be --force--

Col. 19, line 3, claim 1, delete "or" and substitute --for-- therefor

Col. 20, line 24, claim 8, delete "or" and substitute --for-- therefor

Signed and Sealed this

Twenty-eighth Day of September, 1999

*Attest:*

Q. TODD DICKINSON

*Attesting Officer*

*Acting Commissioner of Patents and Trademarks*